United States Patent [19]

Poetzsch et al.

[11] 4,030,386

[45] June 21, 1977

[54] TWIN-EDGED FOAM PLASTIC CLEAVING MACHINE

[75] Inventors: Rolf Poetzsch; Hans Gunther Schuster, both of Freudenberg, Germany

[73] Assignee: Albrecht Bäumer KG Spezialmaschinenfabrik, Germany

[22] Filed: July 11, 1975

[21] Appl. No.: 595,081

[30] Foreign Application Priority Data

July 16, 1975 Germany ..... 2434050

[52] U.S. Cl. ..... 83/4; 83/811; 83/820; 83/661

[51] Int. Cl.² ..... B26D 3/28

[58] Field of Search ..... 83/4, 812, 811, 820, 83/661, 835–855, 661

[56] References Cited

UNITED STATES PATENTS

| | | | |
|---|---|---|---|
| 304,715 | 9/1884 | Emerson | 83/849 |
| 355,077 | 12/1886 | Hanks | 83/804 X |
| 690,678 | 1/1902 | Thomas | 83/661 |
| 1,374,967 | 4/1921 | Trout | 83/818 |
| 1,882,238 | 10/1932 | Kinkel | 83/835 |
| 3,263,537 | 8/1966 | Rehman et al. | 83/4 |
| 3,530,908 | 9/1970 | Crow | 83/4 X |
| 3,736,820 | 6/1973 | Jung | 83/4 |
| 3,850,061 | 11/1974 | Wirstrom | 83/4 |

FOREIGN PATENTS OR APPLICATIONS

| | | | |
|---|---|---|---|
| 2,222,889 | 10/1975 | Germany | 83/820 |
| 2,110AD | 1883 | United Kingdom | 83/661 |

*Primary Examiner*—J. M. Meister
*Attorney, Agent, or Firm*—Gifford, Chandler, Sheridan & Sprinkle

[57] ABSTRACT

A twin-edged foam plastic cleaving machine having a machine frame and a drive for guiding and adjusting a band blade support, a workpiece table (including also a conveyor belt system), movable in relation to the machine frame, for receiving the block of foam plastic to be cut, a twin-edged band blade arrangement, and a truss which is disposed on the side of the band blade remote from the block of foam plastic to support the band blade against yielding both due to a tensile force exerted on the band blade and also due to the reaction compressive force.

11 Claims, 6 Drawing Figures

TWIN-EDGED FOAM PLASTIC CLEAVING MACHINE

BACKGROUND OF THE INVENTION

I. Field of the Invention

The present invention relates to foam plastic cleaving machines and more particularly to such a machine having a new means for supporting the band blade thereof.

II. Description of the Prior Art

In one prior art foam plastic cleaving machine of the kind specified (German Offenlegungsschrift No. 2,222,889) the tensile force is generated by a suction chamber which is disposed between the truss and the band blade and is connected to a suction pump. To give the truss satisfactory stability without its height exceeding a desirable amount, in the prior art apparatus the truss is relatively wide, so that each cutting edge of the twin-edged band blade is covered by the truss. Moving the truss relative to the band blade therefore exposes each cutting edge to be used – i.e. displaces the truss from one cut to the next, two suction chambers of the truss coming into operation alternately. To obtain parallel cuts, both cutting edges of the band blade lie in one, for instance, horizontal plane. However, with a position for the band blade of this kind there are difficulties in parting thin sheets from a block of foam plastics, since during cutting the material escapes, for instance, upwards.

It is therefore an object of the invention to construct a foam plastic cleaving machine of the kind specified such that even thin sheets can readily be cut from the block of foam plastic.

SUMMARY OF THE PRESENT INVENTION

According to the invention there is provided a twin-edged foam plastic cleaving machine having a machine frame and a drive for guiding and adjusting a band blade support, a workpiece table, movable in relation to the machine frame, for receiving the block of foam plastic to be cut, a twin-edged band blade arrangement; and a truss which is disposed on the side of the band blade against yielding both due to a tensile force exerted on the band blade and also due to the reaction compressive force wherein the truss is pivotably mounted and can be pivoted out of the neutral position in the range of ±10° of arc in dependence on the thickness of the block of be cut.

According to a further feature of the invention there is provided a twin edged foam plastic cleaving machine having a machine frame and a drive for guiding and adjusting a band blade support, a workpiece table, movable in relation to the machine frame, for receiving the block of foam plastic to be cut, a twin-edged blade arrangement and a truss which is disposed on the side of the band blade remote from the block of foam plastic to support the band blade against yielding both due to a tensile force exerted on the band blade and also due to the reaction compressive force, wherein the edges of the band blade are formed with cut away portions.

DESCRIPTION OF THE DRAWINGS

One embodiment of the invention will now be described with reference to the drawing wherein.

DESCRIPTION OF A PREFERRED EMBODIMENT

Figure 1:
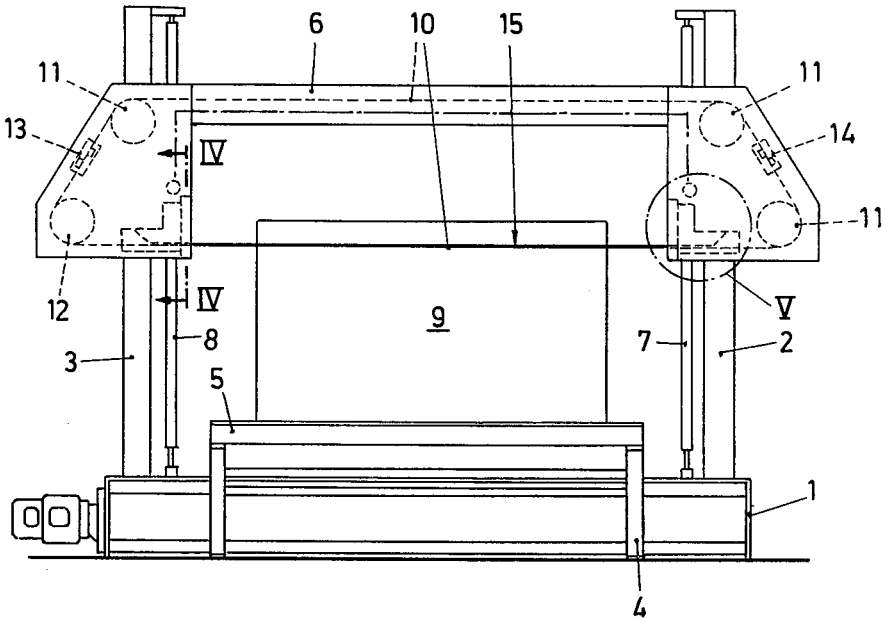
FIG. 1 is a diagrammatic front elevation of a foam plastic cleaving machine.
Figure 2:
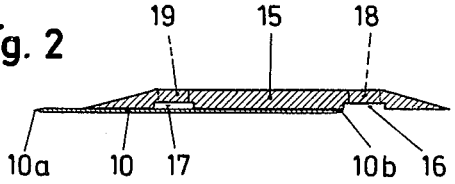
FIG. 2 is a section through a band blade with truss.

The apparatus illustrated in FIG. 1 is a horizontal cleaving machine, comprising a machine frame 1 with guide columns 2, 3, a table frame 4 with a horizontally slideable table 5 and a band blade support 6 whose vertical position in relation to a block 9 of foam plastic can be adjusted by a drive, including spindles 7, 8. A band blade 10 is guided and driven via deflecting and tensioning roller 11 and a drive roller 12 in the band blade support 6. The band blade support 6 also includes a grinding device 13 which constantly keeps one edge of the band blade sharp during operation, a similar grinding device 14 also being provided for the other edge of the band blade 10. Provided in the zone of the bottom run of the band blade 10 between the cheeks of the band blade support is a cutting zone spanned by a truss 15 whose cross-section is shown in FIG. 2. The cross-section of the truss has a substantially trapezoidal outline, the base of the trapezium being formed with cut away portions 16, 17 extending in channel form along the truss until they reach control apertures 18, 19. At its two ends the truss 15 is clamped in tensioning devices 20, a lateral elevation of which is shown in FIG. 5.

The tensioning device 20 consists of two clamping wedges 21, 22, which can be tensioned in relation to one another, and a clamping casing 23 having a slot **23*a*, 23*b* through which the band blade 10 extends, the end of the truss 15 also being introduced into the inside of the casing through the slot 23*a*. On the side adjacent the cutting zone the casing 23 takes the form of a longitudinal guide, a prismatic rolling surface 24 and a flat rolling surface 25 being provided on which corresponding roller bearings 26, 27 roll. The tensioning device 20 also has a tie rod 28 and a turnbuckle nut 29 by means of which the clamping wedges 21, 22 can be pulled to the right, as viewed in the drawing, so that the truss 15** is tensioned.

Figure 4:
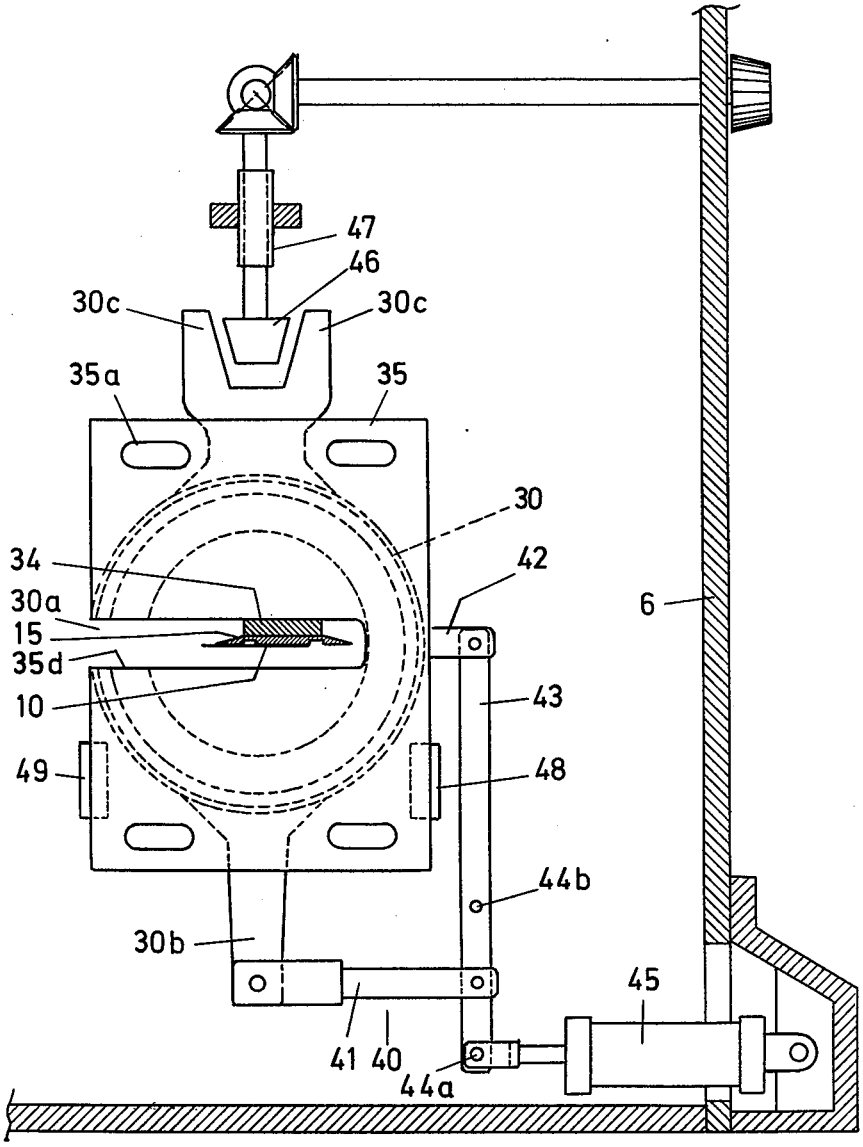
FIG. 4 is a partly sectioned side elevation of a detail from FIG. 1, to an enlarged scale.
Figure 5:
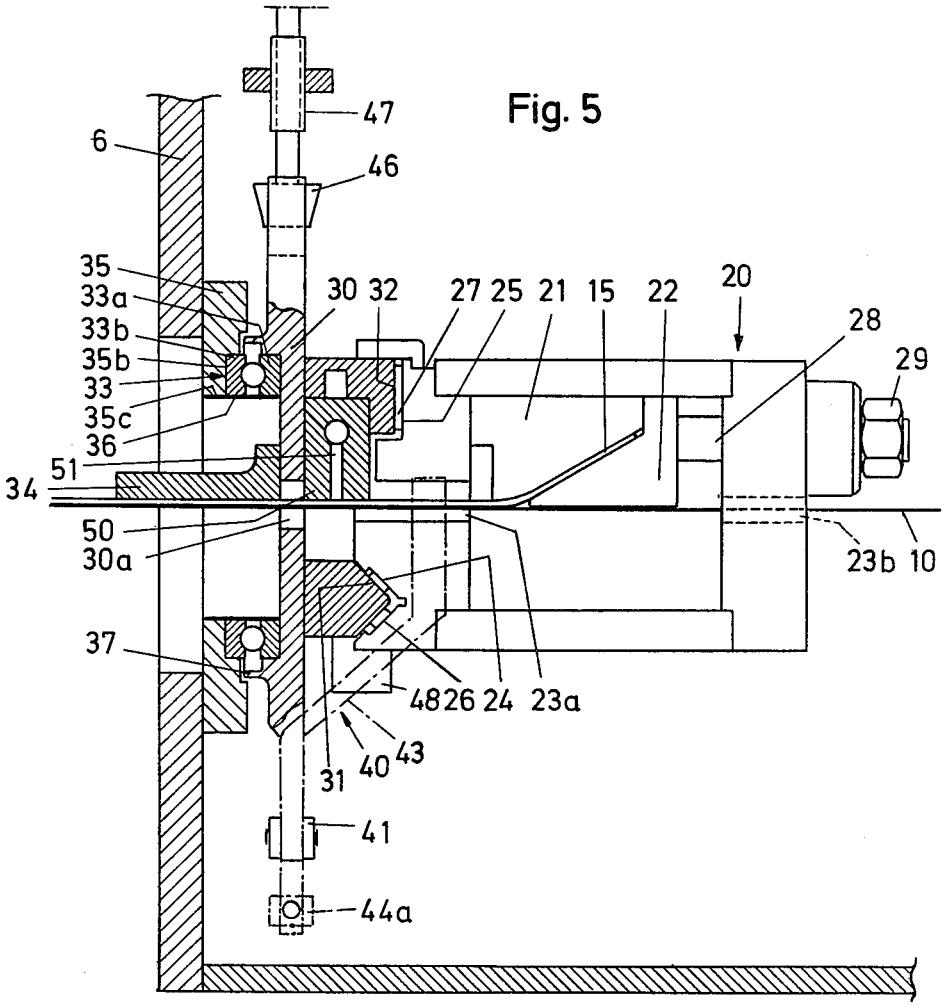
FIG. 5 is a front elevation of the same detail.

At its end on the right, as viewed in FIG. 5 a bearing and supporting member 30 has rolling and guide surfaces 31, 32 which take the form of surfaces matching the rolling surfaces 24, 25 and on which roller bearings 26, 27 roll. Disposed on the opposite side of the bearing and supporting member 30 is a holder 34 and a rotary thrust bearing in the form of a slotted ball bearing 33 which can absorb both compressive forces and also forces operative transversely of the ball bearing races **33*a*, 33*b*. The bearing and supporting member 30 is formed with a slot-shaped aperture 30*a* for the band blade 10 and the truss 15, such aperture lying adjacent the holder 34 in the axis of rotation of the bearing 33 and extending so far to the outside along the direction of movement given by the guide 31, 32 that the band blade 10 can be removed from the rollers 11, 12 and a fresh band blade can be installed. The holder 34 bears the surface of the truss 15, in this way increasing its rigidity against being twisted out of the required position. The bearing and supporting member 30 has an actuating attachment 30*b* (FIG. 4) and a stop attachment 30*c* which initiate and limit a pivoting movement to bring the bearing and supporting member 30 and therefore the truss 15 into the required position. A similar bearing and supporting member is associated with the other end of the truss 15**.

To receive the truss 15 and its clamping and pivoting system 20–34 there is screwed to the casing of the band blade support 6 on either side of the cutting zone an axially adjustable carriage in the form of a plate 35 formed with slots 35*a* (FIG. 4) which allow some correction of adjustment. The plate 35 is formed with an annular groove 35*b* for receiving the ball bearing race 33*b*, and an annular cut away portion 35*c* agreeing with the inside diameter of the ball bearing 33, and a lateral slot 35*d* for the lateral introduction of the band blade 10. Attached to the cut away portion 35*c* is a cover 36 which covers the gap between the two ball bearing races 33*a*, 33*b*. The outer gap of the ball bearing 33 is protected in a similar manner by a cover 37 disposed on the bearing and supporting member 30.

As can best be seen in FIG. 4 the actuating attachment 30*b* of the bearing and supporting member 30 is connected via a linkage 40 to the casing 23 of the clamping device 20 (FIG. 5), the linkage 40 being made up of two thrust rods 41, 42 and a transverse beam 43 which are pivotably connected to one another. Operative at the place 44*a* or 44*b* of the transverse beam 43 is a double-acting pneumatic actuator 45 which is pivotally connected to the casing of the band blade support 6 and bears thereagainst. (Of course a similar device is also provided on the other side of the cutting zone.) Due to the force of the pneumatic actuator 45, the bearing and supporting member 30 can therefore be pivoted and the truss-clamping device 20 displaced. To limit the pivoting movement the stop attachment 30*c* is formed with a symmetrical cut away portion in which a truncated conical stop 46 is disposed which can be displaced in the axial direction by a screw-threaded spindle 47, so that the pivoting zone of the bearing and supporting member 30 depends on the position of the stop 46. Provided on the other side of the band blade support 6 is a similar device 30*c*, 46, 47, the screwthreaded spindles 47 being driven via a common drive (not shown) with spindles and bevel gears so that the amounts of pivoting of the two bearing and supporting members 30 and therefore on the truss 15 are always identical. The amounts of pivoting can be adjusted manually, but automatic adjustment by a motor is also conceivable. The stops 30*c*, 46 limit the pivotability of the bearing and supporting member 30 to ±10°, the actual amount of pivoting to be adjusted depending on the thickness of the sheets to be cut from the block of foam plastic and being substantially smaller. The amount of displacement between the truss-clamping device 20 and the bearing and supporting member 30 is determined by further adjustable stops 48, 49 disposed, for instance, laterally on the guide prisms 31 (FIG. 5). Further fine adjusting means can be used as stops in the form of a continuation of the holder 34 and micrometer screws cooperating therewith.

Referring again to FIG. 5, also mounted in the bearing and supporting member 30 is a suction head 50 which is pressed by the force of a spring against the upper side of the truss 15 at a place where the control apertures 18, 19 are disposed. The suction head 50 is connected to a suction pump (not shown) 0.9 to 0.1 atmospheres absolute and has a channel 51 which is aligned with either control aperture 18 or 19, in dependence on the position of the truss 15. In this way the air is sucked out of either the trough-shaped channel 16 or 17.

The control apertures 18, 19 can also be displaced further to the right, as viewed in FIG. 5, suctional removal channels aligned with the control apertures 18, 19 being provided in the casing 23 of the truss-clamping device 20. In this case a valve control system ensures that only one control aperture 18 or 19 and the channel 16 or 17 connected thereto is connected to the negative pressure source, also in dependence on the position of the truss 15. To absorb the cutting pressure in the cutting direction the rollers 11, 12 of the band blade 10 are crowned, so that the band blade 10 tends to climb onto the periphery of the rollers 11, 12 where the diameter is largest, so that despite of the cutting pressure the center of the band blade 10 remains in a predetermined vertical plane. The truss 15, which is horizontally reciprocated by the pneumatic actuator 45, linkage 40 and clamping device 20, has a central position determined by the stops 48, 49 and the fixing position of the plate 35. The plate 35 is so adjusted and fixed with respect to the stops 48, 49 that in its central position the center of the truss 15 is aligned with the center of the band blade 10 — i.e., lies in the same vertical plane. The center line of the band blade 10 also coincides with the axis of rotation of the bearing 33, so that the truss 15 is pivoted around the center of the band blade 10 when the bearing and supporting member 30 is pivoted.

The machine can have a program scaler (counter) for each of the forward and reverse movements, which accordingly counts the first, third, fifth step etc. and the second, fourth sixth step etc. respectively. An electronic correctional feed device can be associated with the program counters which, in dependence on the difference between the thickness of adjacent sheets and in relation to whether the table 5 makes a forward or reverse movement, varies the amount of adjustment of the band blade support 6 — i.e., provides a fine correction so that sheets of exactly identical thickness are cut off, even if the band blade 10 does not run precisely centrally in relation to the bearing 33.

If it should be found that for certain foam plastics and sheet thicknesses it is more convenient if the particular active cutting edge 10*a* or 10*b* is turned upwards, such pivoting can be carried out by shifting the point of operation of the pneumatic acutator 45 to place 44*b* of the linkage 40.

Instead of using one pneumatic actuator 45 and distributing the force via the linkage 40, two separate actuators can also be used to pivot the bearing and supporting member 30 and move the truss-tensioning device 20. The tensile force can also be exerted on the band blade by magnetism, as well as suction.

In addition to increased output, the main advantage of cutting during the forward and reverse movement of the block of foam plastic guided against the band blade is that such block is not converted into an inclined stack of cut sheets, but a straight stack is produced. (Inclined stacks can be converted into a straight stack only by trimming the inclined edges, and this causes a lot of waste.)

Foam plastic is of course a fairly resilient material; its resilience adjacent the edge of a block of foam plastic is greater than towards the center, merely because there is less supporting material adjacent the edge. If therefore a very thin sheet is to be parted for the first time from a block of foam plastic, at first the band blade will not engage, and penetrate the block only at a certain distance from the edge. When the band blade then arrives adjacent the other edge of the block, there is again the tendency to get thinner, since the plastic can very easily escape upwards from the cutting edge of the band blade. Although these faults can be accepted with a single-edged foam plastic cleaving machine, since after all parallel, if not quite straight cuts are obtained, the effects are more serious in the case of a twin-edged foam plastic cleaving machine, since only the odd or even cuts are parallel with one another.

This disadvantageous tendency can be remedied by placing the band blade at a slight inclination. The clamping devices enable the truss 15 to be tilted slightly, so that the particular cutting edge 10*a* or 10*b* exposed for work points slightly downwards and therefore the foam plastic of the block cannot so easily escape upwards if, when cutting thin sheets the band plate 10 impinges adjacent the top front edge of the block 9 or emerges therefrom adjacent its rear top edge. However, it has also been found that the construction of the band blade itself can contribute towards the solution of the problem described — i.e., towards making the cuts as flat as possible.

Figure 3:
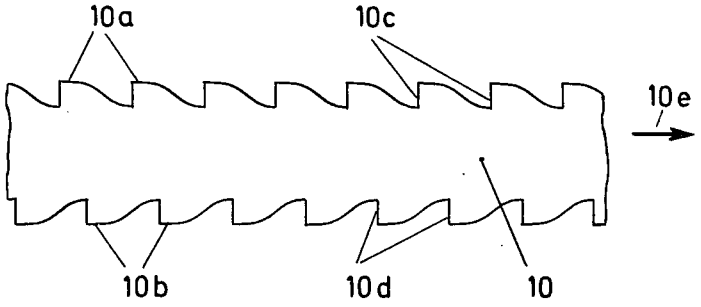
FIG. 3 is a side elevation of a part of a band blade.

As shown in FIG. 3, the edges 10*a*, 10*b* of the band blade 10 are formed with trapezoidal to triangular corrugated cut away portions 10*c*, 10*d*, which have a right angle at the base, so that the edges 10*a*, 10*b* are serrated. Preferably the band blade rotates as indicated by the arrow 10*e*. As a result it is not the tips of the serrated edges which engage in the foam plastic, but the corrugating flanks which, due to the continuous regrinding by the grinding devices 13, 14, soon assume a logarithmic course. In the opposite direction of rotation (opposite to the arrow 10*e*) wear on the band blade 10 is heavier. It has been found that with a band blade constructed as shown in FIG. 5 the foam plastic does not escape so much when the blade arrives adjacent the edge of the block 9. This is possibly due to the fact that the corrugated cutting edges of the band blade enter the pores of the foam plastic and act thereon with small impacts when slipping transversely of the progressive direction of cutting. However, if the plastic yields in this transverse direction, this does not result in the cut sheet becoming thinner.

The depth of the cut away portions 10*c*, 10*d* is not critical, but, due to the continuous regrinding, flat cut away portions do not remain useful for long. Preferably, therefore, the depth of the cut away portions extends about as far as the limit of usefulness up to which the band blade can become worn. Moreover, as can be seen, the cut away portions 10*c*, of one edge 10*a* are offset in relation to the cut away portions 10*d* of the other edge 10*b*, so as not to weaken the rigidity of the band blade unnecessarily in the cutting plane against the cutting pressure. Last but not least, the limit of usefulness of constant regrinding is determined by the rigidity required in the cutting plane. Instead of the serrated semi-corrugated cutting edges 10*a*, 10*b*, completely corrugated forms have also been tried out with satisfactory success.

The foam plastic cleaving machine according to the invention operates as follows: In dependence on the thickness of the sheets to be cut from the block 9 of foam plastic, first the stops 46 are adjusted, in the case of thick sheets to or between −1° and 0°, with thinner sheets between 0 degrees and +2°, and with thin sheets between +2° and +3° of pivoted angle as against the central position. (The negative amount can be produced by connecting the pneumatic actuator 45 to the place 44*b*.) The longitudinal drive of the table 5 produces a relative movement between the block 9 and the band blade 10, so that the foam plastic is cut when the band blade 10 is driven and occupies a corresponding position in height. If this is, for instance, the forward movement of the table, the pneumatic actuating device 45 operates in preparation in such a way that the truss 15 is displaced to the rear (to the right, as viewed in FIG. 4), the bearing and supporting member 30 being simultaneously turned counterclockwise, as viewed in the drawing, so that the front cutting edge 10*a* of the band blade is generally (with connection of the acutator 45 to the place 44*a*) lowered a little. In this position the band blade 10 moves through the block 9 and parts a sheet of predetermined thickness, the plastic having no tendency to escape upwards, due to the inclination of the blade. Before the return movement of the table 5, the band blade support 6 is lowered by the thickness of the sheet to be cut and the pneumatic actuator 45 is changed over, so that the bearing and supporting member 30 (FIG. 4) pivots clockwise and the truss 15 is displaced to the left, the rearward cutting edge 10*b* of the band blade being exposed and the cutting edge also being lowered slightly. When the table 5 makes the reverse movement, therefore, a sheet is again parted from the block 9. In this way a cut takes place for every outward and return movement of the table 5, odd numbers being associated with the forward movements and even numbers with the reverse movements.

If instead of a straight-edged band blade, use is made of a band blade as illustrated in FIG. 3, the inclined position can be reduced as against the stated values of 2° to 3° to about 1° (thus reducing friction during cutting) or the inclined position can be abandoned altogether.

Figure 6:
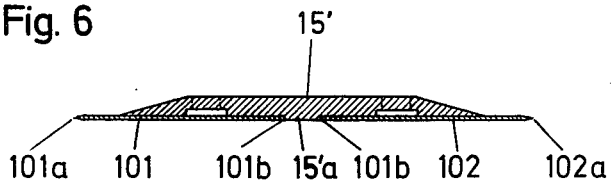
FIG. 6 is a section through a double band blade with truss.

Instead of using a band blade 10 with a front and rear cutting edge 10*a*, 10*b*, two band blades 101, 102 can be used which run spaced-out from one another on two parallel paths. FIG. 6 is a cross-section through a truss 15′ suitable for this which has a spacer web 15′ *a* against which the backs 101*b*, 102*b* of the band blades 101, 102 bear. In this case the cutting edges 101*a*, 102*a* are always outside the truss 15′ — i.e., do not need to be exposed by a relative movement between the band blade and the truss. The devices 20, 27, 31, 32, 48, 49 can then be eliminated, while extra separate tensioning devices are provided for the band blades 101, 102 since it cannot be presumed that the peripheral length of the two band blades will be exactly identical.

The operation of the variant foam plastic cleaving machine corresponds to that of the first embodiment inasmuch as, in dependence on the thickness of the sheets to be parted, the particular operative cutting edge 101*a*, 102*a* is lowered to a varying extent, the difference being that the band blades 101, 102 do not change their position in relation to the truss 15′.

We claim:

1. A twin-edged foam plastic cleaving machine having a machine frame and a drive for guiding and adjusting a band blade support, a workpiece table, movable in relation to the machine frame, for receiving the block of foam plastic to be cut; a twin-edged band blade arrangement, and a truss which is disposed on the side of the band blade remote from the block of foam plastic and which supports the band blade against yielding both due to a tensile force exerted on the band blade and also due to the reaction compressive force wherein the truss is pivotably mounted and can be pivoted out of the neutral position in the range of ±10° of arc in dependence on the thickness of the block to be cut wherein at each of the two ends of the truss a bearing and supporting member is provided which has an aperture for the band blade arrangement and the truss and is mounted via a rotary thrust bearing on the band blade support.

2. The plastic cleaving machine according to claim 1, wherein the pivoting point of the truss coincides with the center of the band blade.

3. The plastic cleaving machine according to claim 1, wherein each rotary thrust bearing of the bearing and supporting members is disposed on a carriage which can be adjusted to and located at the center of the band blade for positioning the neutral position of the truss.

4. The plastic cleaving machine according to claim 1, wherein the bearing and supporting members have stop attachments which limit the pivoting movement of the truss by cooperating with adjusting stops which are located relatively to the band blade support.

5. The plastic cleaving machine according to claim 1, in which the truss, including a tensioning device, is displaced relatively to the band blade arrangement, wherein the bearing and supporting member has a longitudinal bearing for the truss tensioning device and a stop device limits the displacement of the truss including its tensioning device, relatively to the band blade.

6. The plastic cleaving machine according to claim 5, wherein for the pivoting and displacement of the truss only one actuating device is provided at each end of the truss, the actuating device engaging with the bearing and support member on the one hand and the truss-tensioning device on the other and pivoting and displacing such members as far as the associated stop.

7. The plastic cleaving machine according to claim 7, wherein the actuating device comprises a pneumatic actuator and a linkage having at least three operational points, which are subject to the action and reaction by the bearing and supporting member, the truss-tensioning device and the pneumatic actuator.

8. The plastic cleaving machine according to claim 1, in which the tensile force on the band blade is produced by a negative pressure between the band blade and the truss, the truss being formed with chambers and control apertures, characterized in that at least one bearing and supporting member has a suction head which is connected to the negative pressure source and can be pressed by the force of a spring against the control apertures in the truss.

9. The plastic cleaving machine according to claim 1, in which the tensile force on the band blade is produced by a negative pressure between the band blade and the truss, the truss being formed with chambers and control apertures, wherein disposed on at least one truss-tensioning device is a suction device which is connected via a controlled valve device to the negative pressure source and the control apertures.

10. The plastic cleaving machine according to claim 1, with deflecting and drive rollers for the band blade, wherein the deflecting and drive rollers are crowned.

11. The plastic cleaving machine as defined in claim 1 wherein said truss includes a channel adjacent said band blade and said last mentioned means comprises means for supplying a negative pressure to said channel whereby said band blade is held to said truss against the tensile force on the band blade by the suction from the channel.

* * * * *

UNITED STATES PATENT OFFICE

CERTIFICATE OF CORRECTION

Patent No. 4,030,386 Dated June 21, 1977

Inventor(s) Rolf Poetzsch, et al.

It is certified that error appears in the above-identified patent and that said Letters Patent are hereby corrected as shown below:

Claim 6, line 1, after "claim" delete "5" and insert thereinstead -- 4 --.

Claim 7, line 1, after "claim" delete "7" and insert thereinstead -- 6 --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*

UNITED STATES PATENT AND TRADEMARK OFFICE

CERTIFICATE OF CORRECTION

PATENT NO. : 4,030,386

DATED : June 21, 1977

INVENTOR(S) : Rolf Poetzsch and Hans Gunther Schuster

It is certified that error appears in the above-identified patent and that said Letters Patent are hereby corrected as shown below:

Col. 1, line 49, delete "of" (first occurrence), insert --from--; same line, delete "of" (second occurrence), insert --to--.

Col. 7, line 5, delete "of" (second occurrence), insert --from--.

Signed and Sealed this

*Second* Day of *May 1978*

[SEAL]

*Attest:*

RUTH C. MASON
*Attesting Officer*

LUTRELLE F. PARKER
*Acting Commissioner of Patents and Trademarks*